United States Patent [19]

Nakayama et al.

[11] Patent Number: 4,812,287

[45] Date of Patent: Mar. 14, 1989

[54] NICKEL-CHROMIUM STAINLESS STEEL HAVING IMPROVED CORROSION RESISTANCES AND MACHINABILITY

[75] Inventors: Yoshinori Nakayama, Kumagaya; Kikuo Takizawa, Kazo, both of Japan

[73] Assignee: Sanyo Electric Co., Ltd., Osaka, Japan

[21] Appl. No.: 157,265

[22] Filed: Feb. 18, 1988

[30] Foreign Application Priority Data

Apr. 30, 1987 [JP] Japan ..... 62-107362
Apr. 30, 1987 [JP] Japan ..... 62-107363

[51] Int. Cl.[4] ..... C22C 38/40
[52] U.S. Cl. ..... 420/41; 420/52
[58] Field of Search ..... 420/41, 52

[56] References Cited

FOREIGN PATENT DOCUMENTS 38-13760 7/1963 Japan ..... 420/52
47-37332 9/1972 Japan ..... 420/41
52-58013 5/1977 Japan ..... 420/41

OTHER PUBLICATIONS

"Tetsu-to-Hagane (The Journal of the Iron & Steel Inst. of Japan)", 70, (1984), p. 741.
Preconference Text of "33rd Conference Concerning Corrosion and Auticorrosion", (held on Oct. 15-17, 1986 at Naha, Okinawa, Japan, pp. 119-122).

*Primary Examiner*—Deborah Yee
*Attorney, Agent, or Firm*—Wenderoth, Lind & Ponack

[57] ABSTRACT

A nickel-chromium stainless steel having improved corrosion resistances and machinability, comprising less than 0.08 wt. % of C, less than 1.0 wt. % of Si, less than 0.7 wt. % of Mn, less than 0.04 wt. % of P, less than 0.005 wt. % of S, 8.0 to 12.0 wt. % of Ni, 17.0 to 20.0 wt. % of Cr, 0.40 to 0.80 wt. % of Mo, less than 0.3 wt. % of Cu, 0.03 to 0.5 wt. % of Sn and the balance of Fe.

In another embodiment of the present invention, 0.03 to 0.1 wt. % of Bi is added to the above-described composition to further improve the machinability of the stainless steel.

2 Claims, 7 Drawing Sheets

NICKEL-CHROMIUM STAINLESS STEEL HAVING IMPROVED CORROSION RESISTANCES AND MACHINABILITY

BACKGROUND OF THE INVENTION

The present invention relates to a nickel-chromium stainless steel comprising nickel-chromium SUS 304 stainless steel as the base, having improved corrosion resistances and machinability and usable particularly as a preferred material for food machines.

The chemical composition of the SUS 304 steel as stipulated by JIS is as shown in Table 1.

TABLE 1

| C | Si | Mn | P | S | Ni | Cr (wt. %) |
|---|---|---|---|---|---|---|
| <0.08 | <1.0 | <2.0 | <0.04 | <0.03 | 8.0~10.5 | 18.0~20.0 |

Although the SUS 304 steel is widely used as a corrosion-resistant material, its machinability is quite poor. When a free cutting property is required, usually a sulfide inclusion such as MnS was formed purposely at the considerable sacrifice of the corrosion resistance in the prior art. However, it was reported that when the corrosion resistance was regarded as particularly important to make the SUS 304 steel resistant to a strong corrosion environment (for example, a chloride environment or acidic drink environment), it was effective to reduce the ratio of manganese to sulfur (Mn/S) which were the main constituents of MnS in the steel and to increase the amount of chromium dissolved in MnS [see "TETSU-TO-HAGANE (The Journal of the Iron & Steel Inst. of Japan)", 70 (1984), P. 741].

A solid solution treatment at high temperature has been also known to improve the corrosion resistance. For example, when the SUS 304 steel as shown in Table 1 is maintained at about 1300° to 1400° C. for about 1 to 60 minutes and then quenched, the resulting steel exhibits the improved corrosion resistance as compared with the SUS 304 steel treated by a conventional heat treatment at 1050° C. [see Preconference Text of "33rd Conference concerning Corrosion and Anticorrosion" (held on Oct. 15–17, 1986 at Naha, Okinawa, Japan), P. 119–122(1986)].

Though the machinability can be improved to some extent without reducing the corrosion resistance by suitably balancing the formation of MnS with the reduction of the Mn/S or by the solid solution treatment at high temperature, the improvement is yet insufficient.

SUMMARY OF THE INVENTION

An object of the present invention is to provide a nickel-chromium stainless steel comprising SUS 304 stainless steel as the base and having further improved corrosion resistances and machinability.

The first embodiment of the nickel-chromium stainless steel of the present invention having improved corrosion resistances and machinability has a partially modified chemical composition of SUS 304 stainless steel, and comprises less than 0.08 wt. % of C, less than 1.0 wt. % of Si, less than 0.7 wt. % of Mn, less than 0.04 wt. % of P, less than 0.005 wt. % of S, 8.0 to 12.0 wt. % of Ni, 17.0 to 20.0 wt. % of Cr, 0.40 to 0.80 wt. % of Mo, less than 0.3 wt. % of Cu, 0.03 to 0.5 wt. % of Sn and the balance of Fe.

The second embodiment of the nickel-chromium stainless steel of the present invention having improved corrosion resistances and machinability comprises the stainless steel of the above-mentioned first embodiment plus bismuth which is an element capable of improving the machinability. The chemical composition of this steel comprises less than 0.08 wt. % of C, less than 1.0 wt. % of Si, less than 0.7 wt. % of Mn, less than 0.04 wt. % of P, less than 0.005 wt. % of S, 8.0 to 12.0 wt. % of Ni, 17.0 to 20.0 wt. % of Cr, 0.40 to 0.80 wt. % of Mo, less than 0.3 wt. % of Cu, 0.03 to 0.1 wt. % of Bi, 0.03 to 0.2 wt. % of Sn and the balance of Fe.

The above-mentioned and other objects of the present invention will be obvious from the following description made with reference to the drawings.

DETAILED DESCRIPTION OF THE INVENTION

Figure 1:
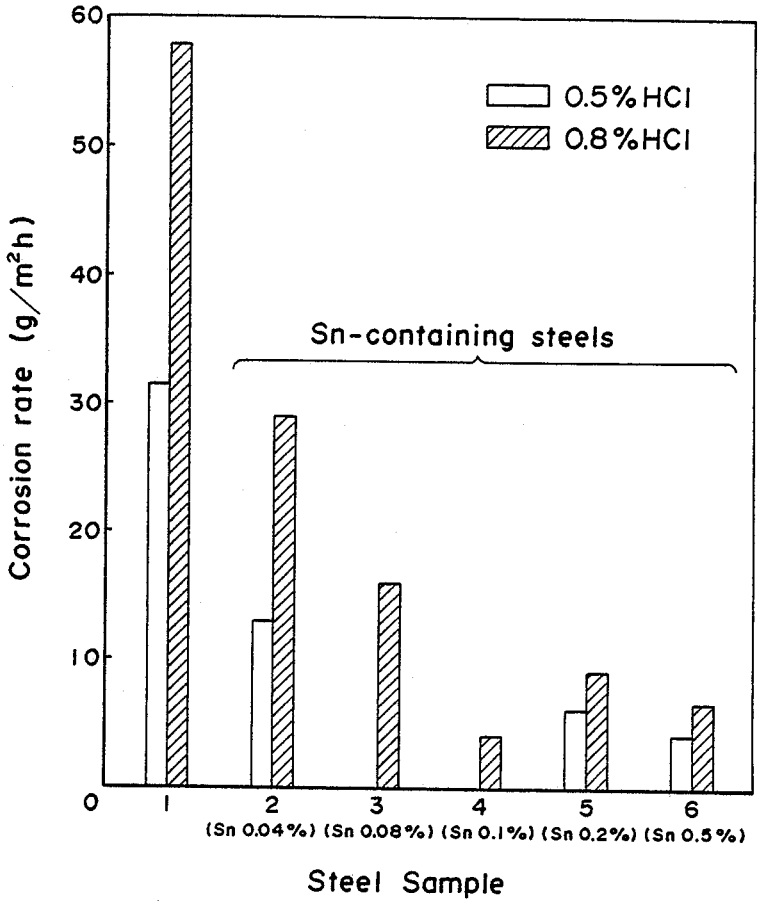
FIG. 1 is a graph showing the corrosion rates of steel samples of the first embodiment of the present invention and a comparative steel sample in dilute hydrochloric acid.

Tin added to the stainless steel in the first embodiment of the present invention serves to improve not only the machinability but also the overall corrosion resistance and crevice corrosion resistance. Particularly in a dilute aqueous sulfuric acid solution, tin deposits on the surface of the steel to increase the hydrogen overvoltage and to improve the resistance to sulfuric acid (overall corrosion resistance). When the amount of tin is less than 0.03 wt. %, the above-mentioned effects of improving the corrosion resistance cannot be exhibited. On the other hand, when it exceeds 0.5 wt. %, the forging property of the steel is reduced and the effect of improving the corrosion resistance is not so much increased.

Although molybdenum and copper are effective in improving both the overall and crevice corrosion resistances, the resistance to corrosion by organic acids might be reduced when the amount of copper is excessive. However, the corrosion resistance for organic acid can be increased by controlling the amount of copper to less than 0.3 wt. % as in the present invention. The optimum amount of molybdenum is 0.40 to 0.80 wt. %, since when the amount is less than 0.40 wt. %, no corrosion resistance can be exhibited and, on the contrary, even when it exceeds 0.80 wt. %, the effect of improving the corrosion resistance is no more significantly increased and the cost is increased.

Although the corrosion resistance can be improved by reducing the amounts of sulfur and manganese as described above, the machinability is reduced. In the present invention, the corrosion resistance can be improved by limiting the amounts of sulfur and manganese to less than 0.005 wt. % and less than 0.7 wt. %, respectively, while the reduced machinability can be made up by the addition of tin.

Nickel is an essential element of an austenitic ($\gamma$) stainless steel to make the $\gamma$-phase stable. In an aspect of the strength, nickel contributes to an improvement of the toughness. When the nickel content is insufficient, the $\gamma$-phase becomes unstable and martensite is formed by the processing to harden the steel and reduce the toughness thereof. Since nickel is electrochemically nobler than iron and chromium, it inhibits the corrosion in an active region. Further nickel imparts to the steel a remarkable resistance to the corrosion by a solution of a neutral chloride or a non-oxidizing acid and it also intensifies the passivity. In the present invention, nickel is used in a content larger than the standard nickel content of the SUS 304 steel to stabilize the $\gamma$-phase, since tin which is a ferrite-forming element is contained therein.

Chromium is an essential component of the stainless steel. It contributes to the passivation of the stainless steel under an oxidizing atmosphere. Namely, the corrosion resistance of the stainless steel is maintained by the passive film. Chromium is thus an indispensable element of the stainless steel.

In the second embodiment of the present invention, the machinability is improved by further adding bismuth to the steel composition of the first embodiment. The amount of bismuth used in the preesent invention is in the range of 0.03 to 0.1 wt. %, since any effect of improving the machinability cannot be obtained with less than 0.03 wt. % and, on the contrary, the forging property is reduced with more than 0.1 wt. % thereof to cause the pitting corrosion and also to affect the corrosion resistances. The stainless steel of the second embodiment of the present invention containing both bismuth and tin has more improved overall corrosion resistance and crevice corrosion resistance than those of the stainless steel containing only bismuth. In the stainless steel of the second embodiment, the amount of tin is 0.03 to 0.2 wt. %, since it contains also bismuth.

Other alloying elements in the present invention, i.e. carbon, silicon and phosphorus, can be used in amounts as stipulated by JIS (SUS 304).

EXAMPLE 1

Steel samples 2 to 6 (tin-containing steel samples) of the first embodiment of the present invention and comparative steel sample 1 (tin-free steel sample) having the chemical compositions shown in Table 2 were prepared. The samples 2 to 6 had various tin contents. The copper content of only the sample 4 was less than 0.3 wt. % (0.28 wt. %) and those of other samples 2, 3, 5 and 6 were less than 0.02 wt. %. The components other than tin and copper were contained substantially in the same amounts in all of the samples. The tin-free comparative sample 1 includes less than 0.02 wt. % of copper and substantially the same amounts of the same components as in the samples 2 to 6.

TABLE 2

(wt. %)

| | C | Si | Mn | P | S | Ni | Cr | Mo | Cu | Sn |
|---|---|---|---|---|---|---|---|---|---|---|
| Sample 1 | 0.009 | 0.48 | 0.28 | 0.001 | 0.002 | 11.02 | 19.04 | 0.64 | 0.01 | 0.00 |
| Sample 2 | 0.003 | 0.47 | 0.27 | 0.001 | 0.002 | 11.08 | 18.98 | 0.65 | 0.01 | 0.04 |
| Sample 3 | 0.006 | 0.48 | 0.27 | 0.000 | 0.002 | 11.12 | 18.84 | 0.65 | 0.00 | 0.08 |
| Sample 4 | 0.004 | 0.48 | 0.31 | 0.001 | 0.002 | 11.13 | 18.79 | 0.69 | 0.28 | 0.10 |
| Sample 5 | 0.003 | 0.48 | 0.27 | 0.001 | 0.002 | 11.09 | 18.66 | 0.70 | 0.00 | 0.20 |
| Sample 6 | 0.003 | 0.48 | 0.26 | 0.001 | 0.002 | 11.14 | 18.20 | 0.70 | 0.00 | 0.50 |

(1) Improvement of overall corrosion resistance

FIG. 1 shows the corrosion rates of the samples 1 to 6 in dilute hydrochloric acid (boiling 0.5% and 0.8% hydrochloric acid solution). Generally the tin-containing steel samples had a lower corrosion rate and more excellent corrosion resistance than those of the tin-free steel sample. Particularly, the samples 3 and 4 were not corroded in 0.5% hydrochloric acid.

Figure 2:
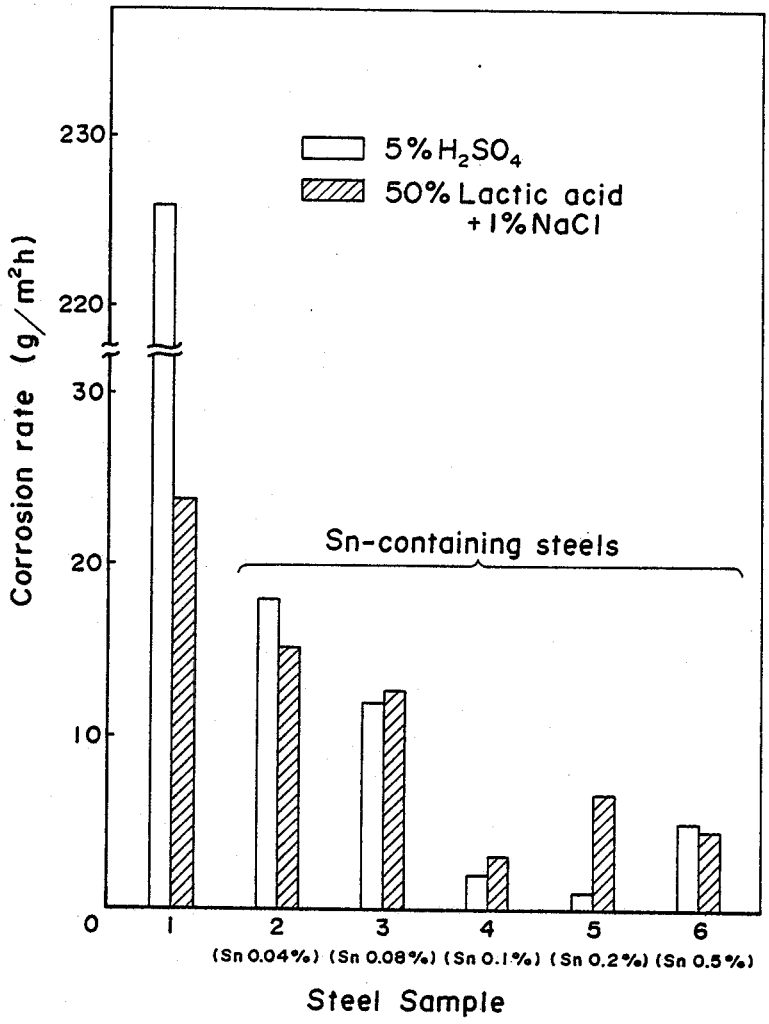
FIG. 2 is a graph showing the corrosion rates of the steel samples of the first embodiment of the present invention and a comparative steel sample in dilute sulfuric acid and in a solution of lactic acid plus common salt (sodium chloride).

FIG. 2 shows the corrosion rates of the samples 1 to 6 in dilute sulfuric acid (boiling 5% sulfuric acid) and in a solution of lactic acid plus common salt (boiling solution containing 50% of lactic acid and 1% of common salt). In the dilute sulfuric acid, the tin-containing steel samples had a far lower corrosion rate and far more excellent corrosion resistance than those of the tin-free steel sample. Also in the solution of lactic acid plus common salt, the tin-containing steel samples had a more excellent corrosion resistance, though the difference between it and that of the tin-free steel sample was not so great unlike in the dilute sulfuric acid.

Figure 3:
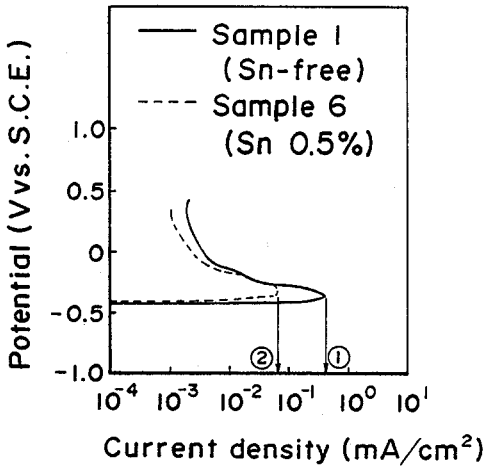
FIG. 3 is a graph showing the anodic polarization characteristics of the steel samples of the first embodiment of the present invention and a comparative steel sample in a solution of dilute sulfuric acid plus common salt.

FIG. 3 shows the anodic polarization curves of the samples 1 and 6 in a solution of dilute sulfuric acid plus common salt (a solution containing 5% of sulfuric acid and 1% of common salt at 30° C.). The critical current density for passivation ($i_{crit}$) as shown by ① and ② in FIG. 3 was lower and an active region was narrower in the sample 6 (tin containing steel sample). This fact suggests that the corrosion resistance in the solution of dilute sulfuric acid plus common salt is improved by the addition of tin.

(2) Evaluation based on the eluting amounts of iron and chromium

Figure 4:
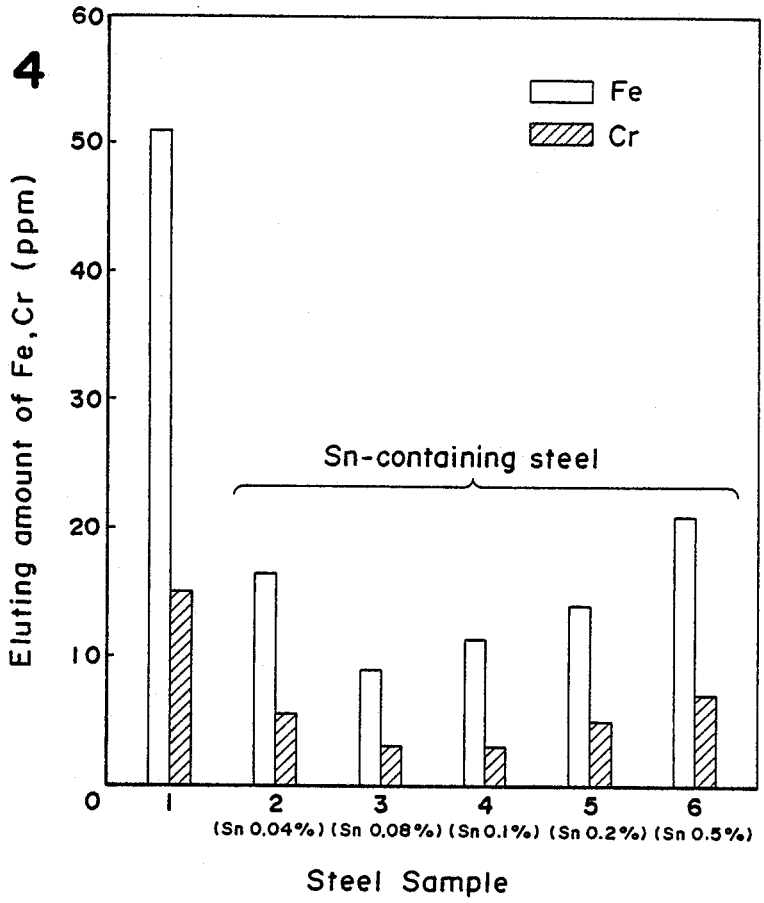
FIG. 4 is a graph showing the amounts of iron and chromium eluted from the steel samples of the first embodiment of the present invention and a comparative steel sample into a solution of lactic acid plus common salt.

FIG. 4 shows the results of the determination of the amounts of iron and chromium eluted out when immersing the samples 1 to 6 in a solution of lactic acid plus common salt (10% lactic acid and 0.3% common salt) at 40° C. for 55 days. The amount of iron eluted from the sample 1 was 50 ppm, while that eluted from the tin-containing steel samples was as small as less than a half of that of the sample 1. As for the eluting amount of chromium, the similar inclination as that of the iron was observed, though the eluting amounts of chromium were various. It is thus apparent also from the eluting amounts of iron and chromium that the tin-containing steel samples had improved corrosion resistances.

(b 3) Improvement in crevice corrosion resistance

Figure 5:
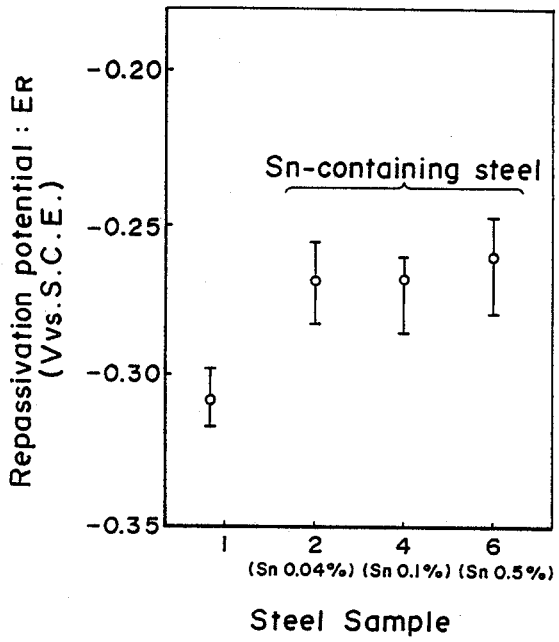
FIG. 5 is a graph showing the repassivation potential of the steel sample of the first embodiment of the present invention and a comparative steel sample in a solution of common salt.

FIG. 5 shows the results of measurement of the repassivation potentials ($E_R$) of the samples 1, 2, 4 and 6 in a solution of common salt (a 3% solution at 30° C.). Usually the higher the value of $E_R$, the easier the repassivation of the sample after the crevice corrosion. Namely, the higher the value of $E_R$, the easier the termination of the crevice corrision. In FIG. 5, the $E_R$ of the tin-containing steel samples was higher than that of the sample 1 to indicate that tin serves to improve the crevice corrosion resistance.

(4) Improvement in machinability

Figure 6:
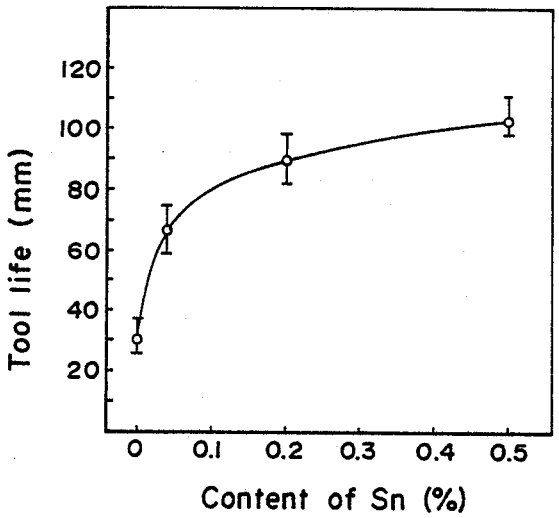
FIG. 6 is a graph showing a relationship between the tin content of the steel sample of the first embodiment of the present invention and a comparative steel sample and the life of a high-speed steel tool used for drilling the steel sample.

FIG. 6 shows the life of a high-speed steel tool SKH-51 (4 mmϕ) used for drilling the steel samples of the present invention. The life of the tool used for drilling the tin-containing steel samples was at least twice as long as that used for drilling the tin-free steel sample. The larger the tin content, the longer the tool life. It is apparent, therefore, that the machinability is improved by the addition of tin.

EXAMPLE 2

A steel sample 8 (steel sample containing both bismuth and tin) of the second embodiment of the present invention and a comparative steel sample 7 (steel sample containing only bismuth) having the chemical compositions shown in Table 3 were prepared.

TABLE 3

| | C | Si | Mn | P | S | Ni | Cr | Mo | Cu | Bi | (wt. %) Sn |
|---|---|---|---|---|---|---|---|---|---|---|---|
| Sample 7 | 0.03 | 0.50 | 0.30 | 0.003 | 0.001 | 10.97 | 18.85 | 0.70 | 0.01 | 0.08 | 0.00 |
| Sample 8 | 0.03 | 0.46 | 0.30 | 0.003 | 0.001 | 10.99 | 18.92 | 0.70 | 0.01 | 0.08 | 0.10 |

(1) Improvement of overall corrosion resistance

Figure 7:
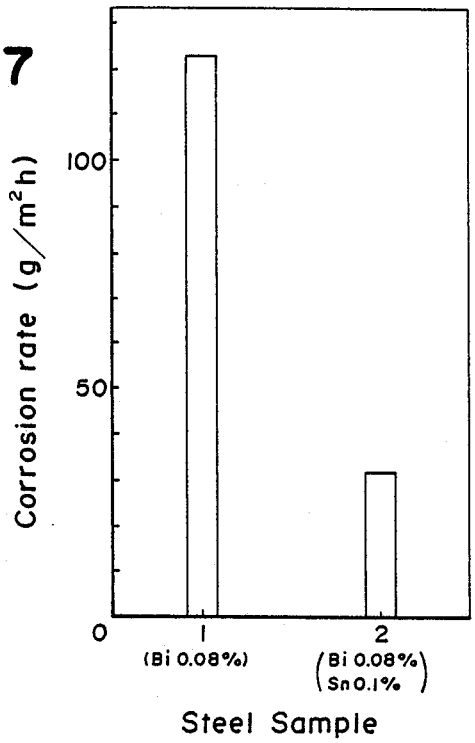
FIG. 7 is a graph showing the corrosion rate of a steel sample of the second embodiment of the present invention and a comparative steel sample in dilute hydrochloric acid.

FIG. 7 shows the corrosion rates of the samples 7 and 8 in dilute hydrochloric acid (boiling 0.8% hydrochloric acid). The corrosion rate of the steel sample containing both bismuth and tin was less than ⅓ of that of the steel sample containing only bismuth to suggest that the former had an improved corrosion resistance.

Figure 8:
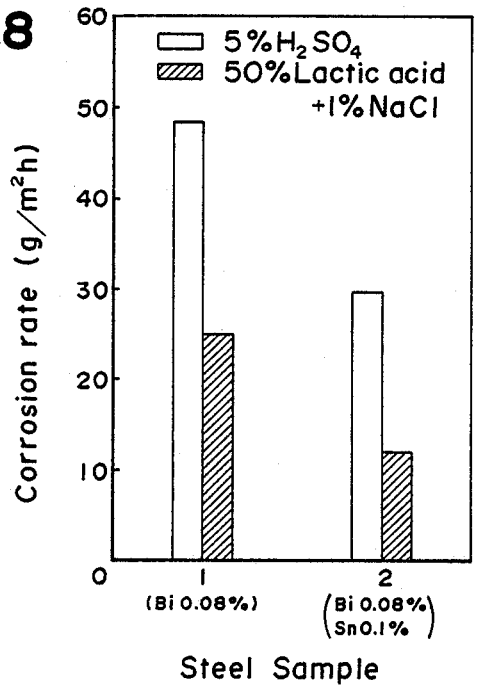
FIG. 8 is a graph showing the corrosion rates of the steel sample of the second embodiment of the present invention and a comparative steel sample in dilute sulfuric acid and in a solution of lactic acid plus common salt.

FIG. 8 shows the corrosion rates of the samples 7 and 8 in dilute sulfuric acid (boiling 5% sulfuric acid ) and in a solution of lactic acid plus common salt (boiling solution containing 50% of lactic acid and 1% of common salt). In both solutions, the corrosion rate of the steel sample containing both bismuth and tin was lower than that of the sample containing only bismuth to suggest that the former had an improved corrosion resistance.

(2) Evaluation based on the eluting amounts of iron and chromium

Figure 9:
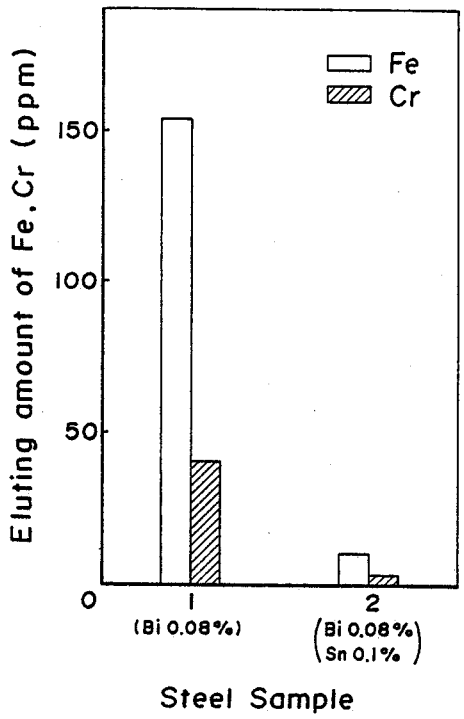
FIG. 9 is a graph showing the amounts of iron and chromium eluted from the steel sample of the second embodiment of the present invention and a comparative steel sample into a solution of lactic acid plus common salt.

FIG. 9 shows the results of the detemrination of the amounts of iron and chromium eluted when immersing the samples 7 and 8 in a solution of lactic acid plus common salt (10% lactic acid and 0.3% common salt) at 40° C. for 55 days. The amount of iron eluted from the steel sample 7 was more than 150 ppm, while that eluted from the steel sample 8 was less than 1/10 of that of the sample 7. Also the amount of chromium eluted from the sample 8 was about 1/10 of that eluted from the sample 7. Thus, it is apparent from the eluting amounts of iron and chromium that the steel containing both bismuth and tin had a remarkably improved corrosion resistance.

(3) Improvement in pitting corrosion resistance

Figure 10:
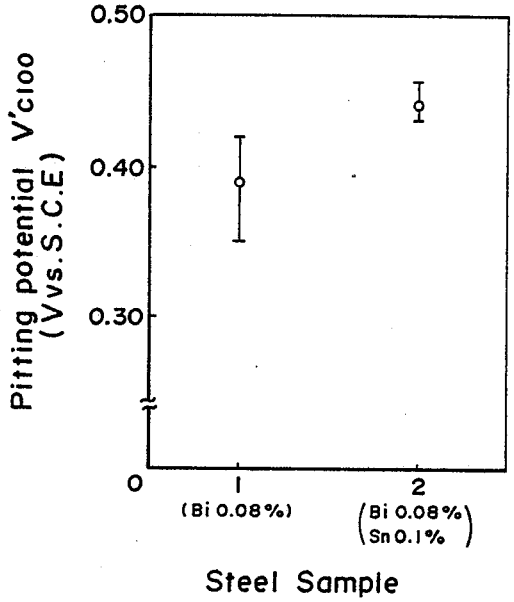
FIG. 10 is a graph showing the pitting potential of the steel sample of the second embodiment of the present invention and a comparative steel sample in a solution of common salt.

FIG. 10 shows the results of the determination of the pitting potential (V'c100) of the samples 7 and 8 in a solution of common salt (a 3% solution at 30° C.). Usually the higher the value of V'c100, the more difficult the occurrence of the pitting corrosion. The V'c100 of the steel sample containing both bismuth and tin was nobler than that of the sample containing only bismuth by 50 mV on average. It is apparent, therefore, that the addition of both bismuth and tin improves the pitting corrosion resistance.

(4) Improvement in crevice corrosion resistance

Figure 11:
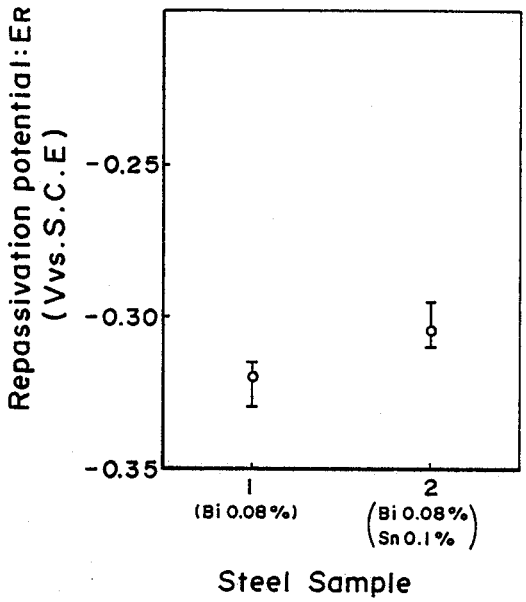
FIG. 11 is a graph showing the repassivation potential of the steel sample of the second embodiment of the present invention and a comparative steel sample in a solution of common salt.

FIG. 11 shows the results of the measurement of the repassivation potential ($E_R$) of the samples 7 and 8 in a solution of common salt (a 3% solution at 30° C.). Usually the higher the value of $E_R$, the easier the termination of the crevice corrosion. It is apparent from FIG. 11 that the $E_R$ of the steel sample containing both bismuth and tin was higher than that of the steel sample containing only bismuth and that the addition of both bismuth and tin served to improve the crevice corrosion resistance.

(5) Improvement in machinability

Figure 12:
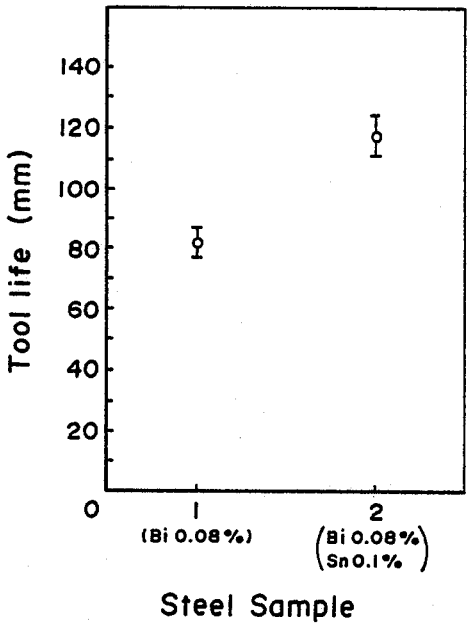
FIG. 12 is a graph showing the life of a high-speed steel tool used for drilling the steel sample of the second embodiment of the present invention and a comparative steel sample.

FIG. 12 shows the life of a high-speed steel tool SKH-51 (4 mmϕ) used for drilling the samples 7 and 8. The life of the tool used for drilling the sample containing both bismuth and tin was longer than that used for drilling the sample containing only bismuth. It is apparent, therefore, that the improvement in the machinbility realized by the addition of both bismuth and tin was more remarkable than that realized by the addition of only bismuth.

As described above, the stainless steel of the present invention is remarkably superior in corrosion resistances and machinability to SUS 304 stainless steel. This stainless steel can be particularly preferably used as a material for food machines which requires excellent corrosion resistances.

While the invention has been described with respect to preferred embodients, it should be apparent to those skilled in the art that numerous modifications may be made thereto without departing from the scope of the invention.

What is claimed is:

1. A nickel-chromium austenitic stainless steel having improved corrosion resistances and machinability, comprising less than 0.08 wt. % of C, less than 1.0 wt. % of Si, less than 0.7 wt. % of Mn, less than 0.04 wt. % of P, less than 0.005 wt. % of S, 8.0 to 12.0 wt. % of Ni, 17.0 to 20.0 wt. % of Cr, 0.40 to 0.80 wt. % of Mo, less than 0.3 wt. % of Cu, 0.03 to 0.5 wt. % of Sn and the balance of Fe.

2. A nickel-chromium austenitic stainless steel having improved corrosion resistances and machinability, comprising less than 0.08 wt. % of C, less than 1.0 wt. % of Si, less than 0.7 wt. % of Mn, less than 0.04 wt. % of P, less than 0.005 wt. % of S, 8.0 to 12.0 wt. % of Ni, 17.0 to 20.0 wt. % of Cr, 0.40 to 0.80 wt. % of Mo, less than 0.3 wt. % of Cu, 0.03 to 0.1 wt. % of Bi, 0.03 to 0.2 wt. % of Sn and the balance of Fe.

* * * * *